US008240052B2

(12) United States Patent
Waits et al.

(10) Patent No.: US 8,240,052 B2
(45) Date of Patent: Aug. 14, 2012

(54) PROCESS OF FORMING AN INTEGRATED MULTIPLEXED ELECTROSPRAY ATOMIZER

(75) Inventors: Christopher Michael Waits, Silver Spring, MD (US); Bruce Robert Geil, Baltimore, MD (US); Nicholas Robert Jankowski, Catonsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 636 days.

(21) Appl. No.: 12/199,032

(22) Filed: Aug. 27, 2008

(65) Prior Publication Data

US 2009/0056133 A1 Mar. 5, 2009

Related U.S. Application Data

(60) Provisional application No. 60/968,674, filed on Aug. 29, 2007.

(51) Int. Cl.
*B21D 51/16* (2006.01)

(52) U.S. Cl. ..... 29/890.143

(58) Field of Classification Search ..... 29/890.143
See application file for complete search history.

(56) References Cited

U.S. PATENT DOCUMENTS

| | | | | |
|---|---|---|---|---|
| 6,297,584 | B1 * | 10/2001 | Kim et al. | 313/293 |
| 2007/0206044 | A1 * | 9/2007 | Kinpara | 347/20 |
| 2009/0032724 | A1 * | 2/2009 | Lozano et al. | 250/398 |

FOREIGN PATENT DOCUMENTS

WO WO 2006009854 A2 * 1/2006

OTHER PUBLICATIONS

Tang et al., Generation of Multiple Electrosprays using Microfabricated Emitter Arrays for Improved Mass Spectrometric Sensitivity, Analytical Chemistry, vol. 73, No. 8, Apr. 15, 2001, p. 1658.*

T. Gorman, P. Enoksson and Göran Stemme, "Deep wet etching of borosilicate glass using an anodically bonded silicon substrate as mask," Journal of Micromechanics and Microengineering, vol. 8, pp. 84-87, 1998. This reference teaches wet etching of Pyrex using anodically bonded silicon as a masking layer . . . this is the most relevant to Applicant's process.

(Continued)

*Primary Examiner* — David Bryant
*Assistant Examiner* — Moshe Wilensky
(74) *Attorney, Agent, or Firm* — Avrom D. Spevack

(57) ABSTRACT

A process for forming an integrated multiplex electrospray includes forming multiple holes in a ring extractor substrate to create a ring extractor. A nozzle array having multiple nozzles each nozzle defining a central axis is provided. A spacer layer is bonded to either the ring extractor or the nozzle array to form a bonded stack. The bonded stack is then aligned with remaining layer to align each of the multiple nozzles with one of the plurality of holes to less than 10 microns from concentric and the spacer layer then bonded intermediate between the ring extractor and the nozzle array layer. The spacer layer is then etched to provide fluid communication between multiple nozzles and the multiple holes of the ring extractor and form the spacer.

3 Claims, 7 Drawing Sheets

(6A)

(6B)

(6C)

OTHER PUBLICATIONS

C. Iliescu, K.L. Tan, F.E.H. Tay, J.M. Miao, "Deep wet and dry etching of Pyrex glass: a Review", Proceedings of the ICMAT (Symposium F), Singapore, Jul. 2005, pp. 75-78. This reference teaches wet etching and dry etching of Pyrex. This reference even includes silicon as a masking material (inert in HF solutions).

M. Bu, T. Melvin, G.J. Ensell, J.S.Wilkinson, A.G.R. Evans, "A New Masking Technology for Deep Glass Etching and Its Microfluidic Application", Sens.Actuator A: Phys. 115 (2004) 476-482. This reference teaches wet etching of Pyrex substrates.

Scalable Electrospray Components for Portable Power Applications Using MEMS Fabrication Techniques C. M. Waits, N. Jankowski, and B. Geil U.S. Army Research Laboratory, Adelphi, MD 25th Army Science Conference, Scalable Electrospray Components for Portable Power.

* cited by examiner (6A)

(6B)

(6C)

(7A)

(7B)

(7C)

(7D)

PROCESS OF FORMING AN INTEGRATED MULTIPLEXED ELECTROSPRAY ATOMIZER

CROSS-REFERENCE TO RELATED APPLICATIONS

This application claims priority of U.S. Provisional Patent Application Ser. No. 60/968,674 filed Aug. 29, 2007, which is incorporated herein by reference.

GOVERNMENT INTEREST

The invention described herein may be manufactured, used, and licensed by or for the United States Government.

FIELD OF THE INVENTION

The present invention relates in general to a process for forming an integrated multiplexed electrospray atomizer and in particular to a process for such formation with improved component alignment.

BACKGROUND OF THE INVENTION

Electrospray involves breaking the meniscus of a charged liquid formed at the end of a capillary tube into fine droplets using an electric field. The electric field induced between the electrode and the conducting liquid initially causes a Taylor cone to form at the tip of the tube where the field becomes concentrated. Fluctuations cause the cone tip to break up into fine droplets, and Coulomb interaction between neighboring liquid ions causes them to separate from one another while being pulled towards the electrode. The droplet diameter has a power law dependence on the flow rate of the fuel ($D \propto \dot{Q}^{0.5}$ for JP-8 diesel (Deng et al. 2006a)) implying that the flow rate has to be decreased to reduce the droplet size. In portable power generation applications, this requirement correlates to a flow rate that is too small to be useful.

Small scale portable power systems based on the combustion of liquid hydrocarbons have become of great interest in the last decade (Epstein et al. 1997, Fréchette et al. 2003, Walther and Pisano 2003, Kyritsis et al. 2002). These combustion systems take advantage of the significantly higher energy density available in liquid hydrocarbons when compared to conventional batteries (at only 10% efficiency, diesel fuel can yield 5 MJ/kg, 10 times more than the 0.5 MJ/kg for primary batteries). Compact combustion devices in the cubic centimeter ($cm^3$) range will likely use catalytic conversion and diffusion controlled combustion requiring the fuel to be delivered as small and rapidly evaporating droplets (Deng et al. 2006a).

Multiplexed electrospray is arraying the tubes or nozzles, thereby increasing the overall flow rate without affecting the size of the ejected droplets. In order to maximize the flow rate and miniaturize the entire system, Microelectromechanical Systems (MEMS) fabrication techniques can be used to create densely packed nozzles and integrate them with the other components. FIG. 1 depicts a prior art multiplexed electrospray atomizer with a ring extractor electrode and a grounded plane. The ring extractor acts to shield the droplet formation region (between nozzle array layer and ring extractor) from the spray region (ring extractor to ground plane) where space-charge effects become dominant. The ground plane provides a removal force to prevent droplets from flying back to the ring extractor.

Further reduction in the size of the multiplexed electrospray is currently restricted by the manual assembly technique of the components (Deng et al, 2006a). Current alignment accuracy is limited to 50 μm (microns) and prevents the assembly of smaller than conventional electrospray components. Because droplet characteristics are not affected by the changes in nozzle dimensions, improved fabrication and assembly techniques can shrink the nozzle size and increase the nozzle density. Increased nozzle density would allow further increases in device flow rate capability while maintaining sub-10 μm droplet diameters.

Thus, there exists a need to develop a process to fabricate an integrated multiplex electrospray atomizer with smaller features. There also exists a need to assemble multiplex electrospray components with greater alignment accuracy (or precision) occurring so as to promote higher electrospray flow rates with desirable droplet sizes.

SUMMARY OF THE INVENTION

A process for forming an integrated multiplex electrospray atomizer having a ring extractor, a nozzle array and a spacer intermediate between the ring extractor and the nozzle array is provided. The process includes forming multiple holes in a ring extractor substrate to create a ring extractor. A nozzle array having multiple nozzles is provided with each nozzle defining a central axis. A planar spacer layer is bonded to either the ring extractor or the nozzle array to form a bonded stack spacer-ring extractor or spacer-nozzle array. A spacer layer-ring extractor bonded stack is then aligned with a nozzle array or a spacer layer-nozzle array layer is aligned with a ring extractor to align each of the multiple nozzles with one of the plurality of holes. The planar spacer of the bonded stack is then bonded intermediate between the ring extractor and the nozzle array layer. The planar spacer is then etched to provide fluid communication between multiple nozzles and the multiple holes of the ring extractor and form the spacer. In a particular embodiment, a ring extractor is formed through dual-sided photolithography to form a peripheral edge having a ring extractor edge thickness greater than a ring extractor substrate thickness defining the multiple holes.

The need to etch the spacer layer to form a spacer is obviated by the deposition of a thin film dielectric layer on either the ring extractor or the nozzle array layer and bonding the ring extractor to the nozzle array layer with the thin film dielectric located there between resort to a separate spacer layer.

A process for forming an integrated multiplex electrospray including a ring extractor, a nozzle array and a spacer intermediate therebetween is provided that includes using MEMS fabrication to form a mold of the ring extractor. A ring extractor is then deposited in the mold cavity and separating the ring extractor therefrom. The mold is optionally bonded to the nozzle array and functions as the spacer layer.

DETAILED DESCRIPTION OF THE PREFERRED EMBODIMENTS

The present invention has utility as a process to assemble an integrated multiplexed electrospray atomizer with superior alignment accuracy thereby making possible more compact devices with higher flow rates and lower operating voltage. Through the manufacture of multiplexed electrospray components and in particular a ring extractor with greater accuracy and techniques facilitating alignment with a bond aligner, concentric alignment tolerances of 10 microns or less are obtained between a nozzle central axis and a ring extractor hole. The enhanced tolerances greatly improve performance of the resultant device. Alignment tolerances of less than 5 microns and even less than 1 micron are routinely obtained by an inventive process. In contrast, previous alignment processes of such devices only obtained alignment accuracies on the order of 50 microns thereby limiting device scaling and performance.

Figure 1:
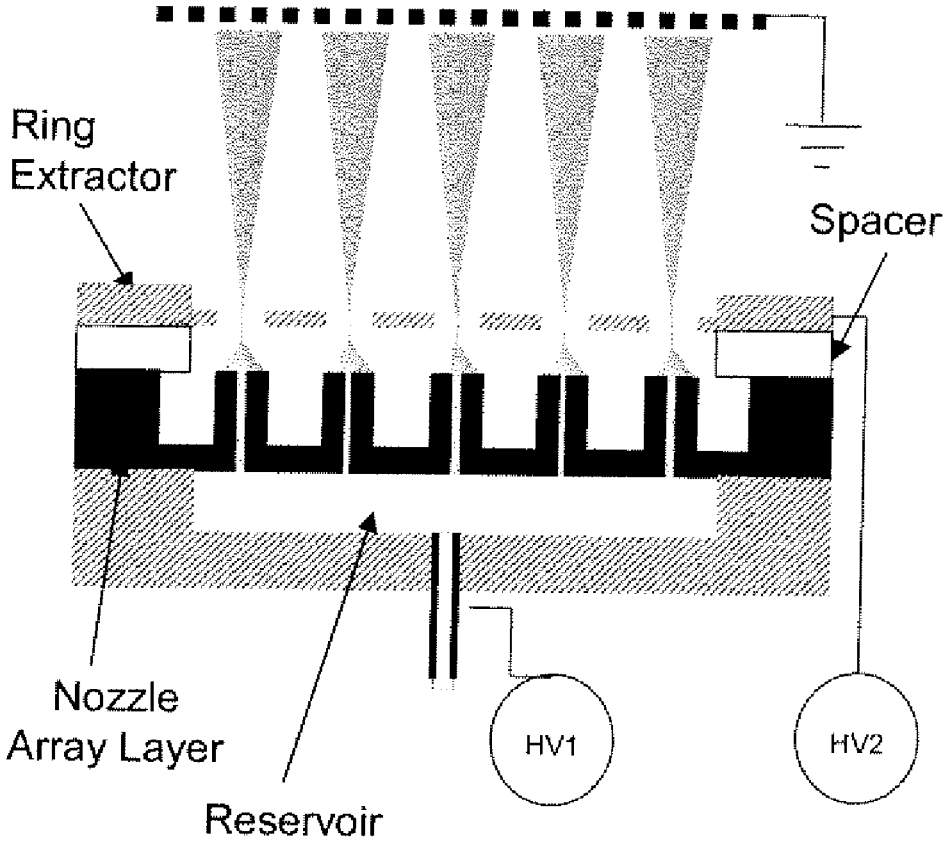
Fig.1 Prior Art
FIG. 1 is a transverse cross-sectional schematic of a prior art multiplexed electrospray device in operation. A liquid reservoir is in fluid communication with a nozzle array to propel liquid droplets through a spacer gapped ring extractor under a differential potential between the liquid within the reservoir and the ring extractor.

An integrated multiplexed electrospray atomizer according to the present invention has the same components as provided with respect to prior art FIG. 1 and includes a ring extractor which acts upon application of a voltage supporting electrode thereto pulls droplets from a nozzle, and shields the nozzles from space-charge effects. A spacer provides electrical standoff to provide isolation between differential potentials applied between the ring extractor and the nozzles. Unlike a conventional integrated multiplexed electrospray atomizer, an inventive process affords a degree of alignment previously unattainable.

Referring now to FIGS. 2A-2D, transverse cross-sectional schematics show the steps of forming a uniform thickness ring extractor through a photolithographic process. A ring extractor substrate is provided having at least one planar surface. A ring extractor substrate is formed from a variety of materials illustratively including semiconductors such as silicon, gallium arsenide, and silicon carbide; metals such as titanium, tungsten, aluminum, copper, alloys thereof, steel and stainless steel; ceramics such as aluminum oxide, aluminum nitride, silicon nitride, and Al—SiC; and glasses such as quartz, and borosilicate. Regardless of the ring extractor substrate, an electrode is either formed from a conductive substrate or a conductive layer operative as an electrode is overlaid thereon. It is appreciated that a ring extractor substrate 12 thickness is dependent upon the material selection and correlates with material properties such as structural rigidity and resistance to stress fracturing in the course of subsequent inventive process fabrication. It is appreciated that a ring extractor of excess thickness degrades cone-jet operation of the resultant electrospray. Performance degrading attributes of an excessively thick ring extractor include disturbed propagation of the diverging droplet spray as droplets impinge upon the sidewalls of the extractor hole, flood the device and stop operation. Excess thickness can be mitigated through resort to conical holes in the ring extractor. It is appreciated that forming of holes at varying cross-sectional area through the ring extractor substrate complicates ring extractor formation.

The present invention is further detailed with respect to FIGS. 2-6. It is noted that these figures are dimensionally distorted for illustrative purposes and that the comparative thickness of various layers, as well as patterned features, have been modified to aid in visual understanding of an inventive process. Like numerals used with respect to different Figures are intended to have a uniform meaning.

Figures 2A, 2B, 2C, 2D:
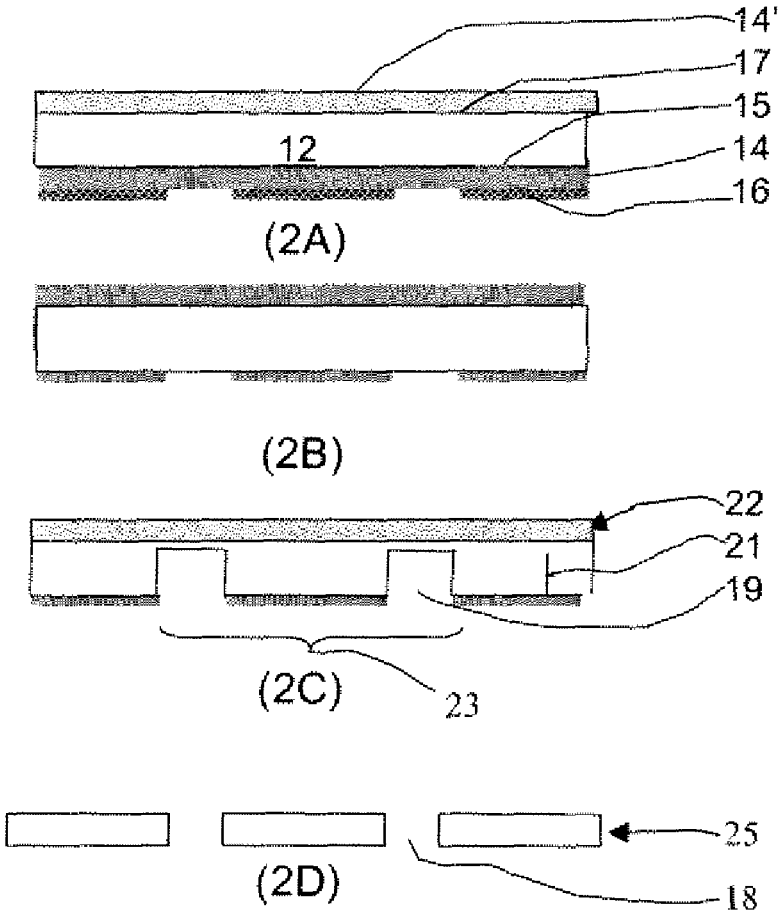
FIGS. 2A-2D are transverse cross-sectional schematics showing the steps of forming a uniform thickness ring extractor by a photolithographic process.

With respect to FIG. 2, the ring extractor substrate 12 is depicted as having a disparate surface coating 14. In the instances when ring extractor substrate 12 is a semiconductor or a metal, the disparate surface material 14 is typically an oxide or nitride. Representative disparate surface material layers 14 illustratively include silicon dioxide or silicon carbide on silicon, titanium nitride on titanium, tantalum nitride on tantalum, tungsten nitride on tungsten, and aluminum gallium arsenide on gallium arsenide. As shown in FIG. 2A, a photolithographic photoresist 16 is patterned onto the ring extractor substrate 12. It is appreciated that the disparate surface material 14 is optionally removed prior to patterning the photoresist 16 onto the substrate 12. In such instances the photoresist 16 is applied directly to a clean surface of ring extractor substrate material 12. It is appreciated that the etch characteristics of the disparate surface material 14 most often dictate whether this layer 14 is wholly removed prior to application of photoresist 16. For purposes of illustration according to FIG. 2, the disparate surface material layer 14 remains after application of the photoresist 16. The disparate surface material layer 14 is removed in a patterned manner as dictated by the application pattern of the photoresist 16. While for purposes of illustration FIG. 2 depicts a positive photoresist 16, it is appreciated that a negative photoresist is also operative herein. Preferably, disparate surface material layer 14 is etched using reactive ion etching (RIE). Other conventional etching procedures are operative herein. As shown in FIG. 2C, a second photolithography step is performed to etch an array of holes 18 through the ring extractor substrate 12 in a hole array region 23. While a variety of conventional etch processes as detailed with respect to FIG. 2B are operative in the etching of the array of holes 18, preferably deep reactive ion etching (DRIE) is utilized to maintain dimensional tolerances of the array of holes 18. Optionally, any remaining disparate surface material layer 14 is removed from the etched surface 15, the opposing surface 17, or a combination thereof by processes conventional to the art (not shown). By way of example, silicon dioxide disparate surface material layer 14 is removed from surface 15 with a conventional stripping solution of aqueous hydrofluoric acid. It is appreciated that retaining a disparate surface material layer 14 on the etched surface 157 the opposing surface 17, or a combination thereof affords advantages in some instances. These advantages illustratively including surface protectant, environmental passivation, or formation of a conductive electrode.

Figures 3A, 3B, 3C, 3D, 3E, 3F, 3G:
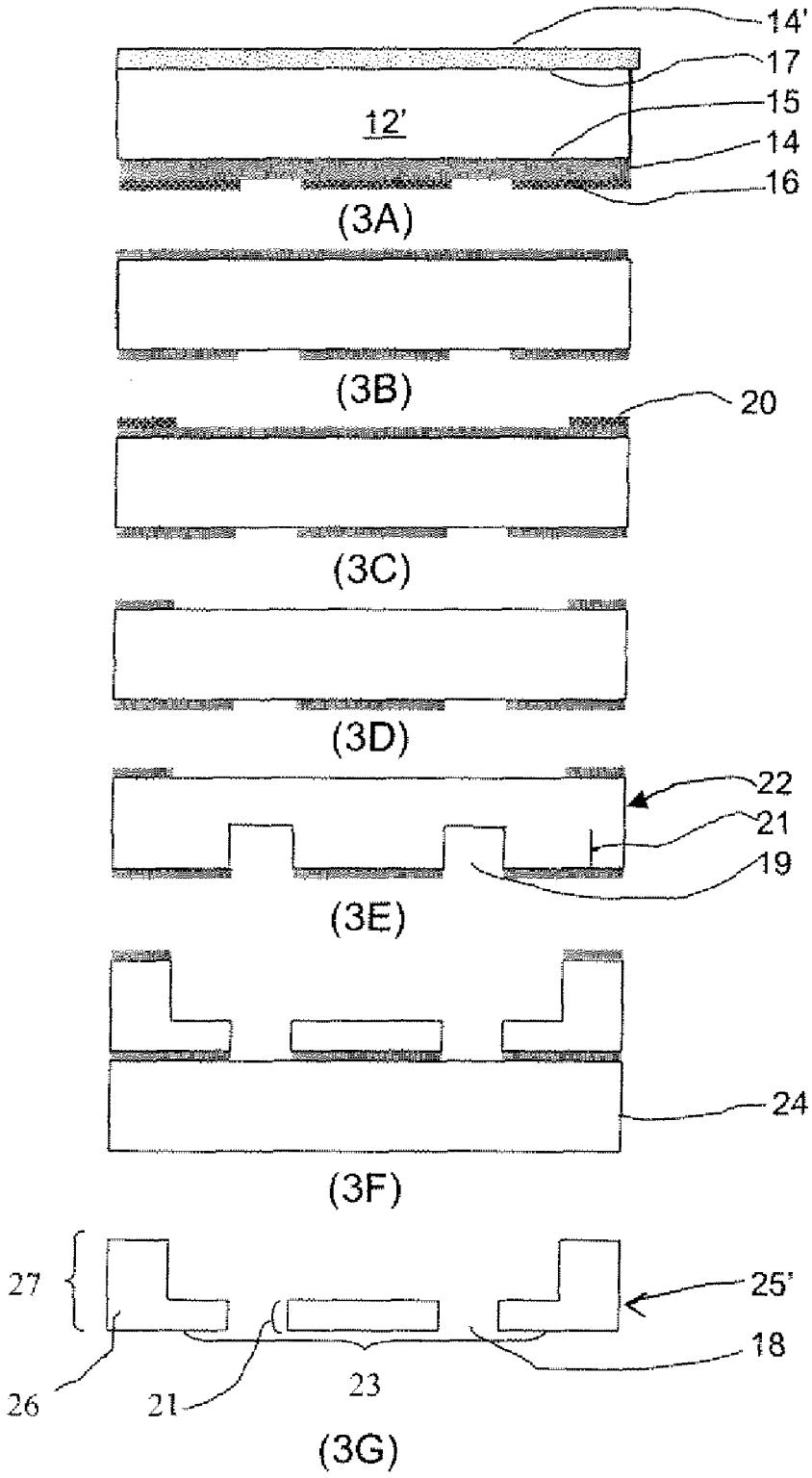
FIGS. 3A-3G are transverse cross-sectional schematics showing the steps of forming a ring extractor with a raised peripheral edge relative to the hole array area by a dual side photolithographic process.

FIGS. 3A-3G depict as transverse cross-sectional schematics the steps of forming a ring extractor having a raised peripheral edge relative to a hole array area. In FIG. 3A, a ring extractor substrate 12' is provided that has a thickness greater than that is optimal for a ring extractor for a given material yet is otherwise identical to ring extractor substrate 12. In the instance of ring extractor substrate 12' being a silicon wafer, the silicon wafer ring extractor substrate 12' has a thickness of greater than 250 microns and typically has a thickness of between 300 and 800 microns. The process steps detailed with respect to FIGS. 2A and 2B are repeated in FIGS. 3A and 3B. In FIG. 3C, a patterned photoresist 20 is applied to opposing surface 17. The pattern of the photoresist 20 is such to create a preferential removal of surface material layer 14' from the ring extractor substrate 12' from the opposing surface 17 overlying the hole array region 23. A second RIE or other etching is depicted in FIG. 3D to remove disparate surface material layer 14' from the opposing surface 17. The disparate surface material layer 14' corresponds to the description of disparate surface material layer 14 yet exists on the opposing surface 17. It is appreciated that for a given substrate 12' layers 14 and 14' need not be of identical composition.

Figures 4A, 4B, 4C:
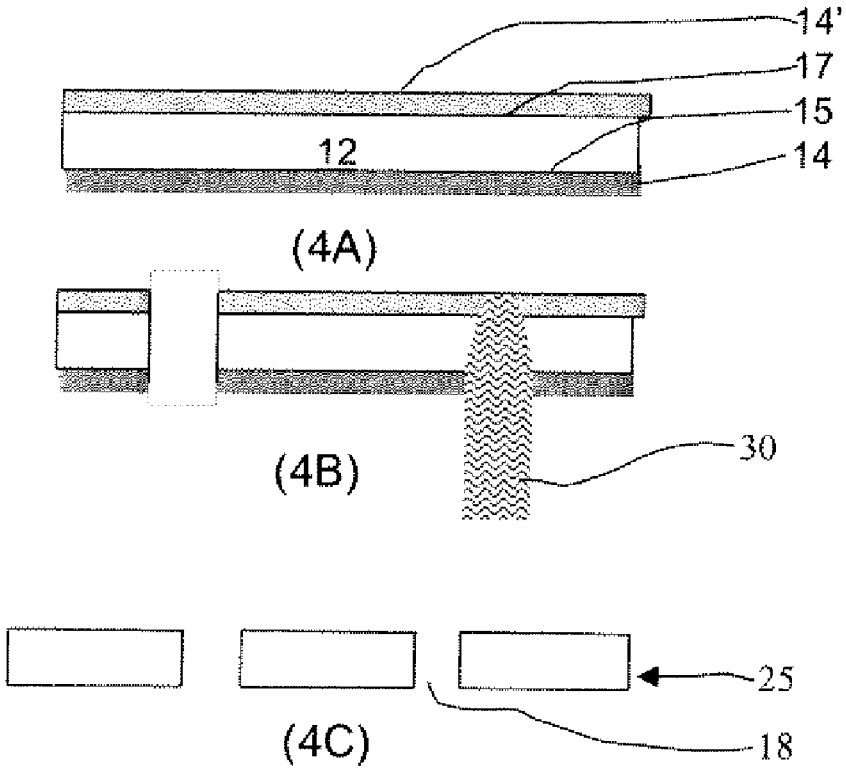
FIGS. 4A-4C are transverse cross-sectional schematics showing the steps of forming a uniform thickness ring extractor by a laser boring process.

After the etching of the opposing surface 17 to remove disparate surface material layer 14' in a preselected pattern, the array of holes 18 is etched through the surface 15 as shown in FIG. 3E. It is noted that this process is consistent with that detailed with respect to FIG. 2C with the exception that owing to the increased thickness of substrate 12' the array of holes 18 do not extend through to communicate with opposing surface 17. Preferably, the etch depicted in FIG. 3E is a deep reactive ion etching (DRIE) process and more preferably is to a depth greater than the desired thickness of material defining the etched pits 19. The front side etched substrate depicted in FIG. 3E at 22 is then inverted and attached to a carrier 24. Conventional forms of adhesion between a carrier 24 and a front side etched substrate 22 illustratively include resort to thermal grease and a polymeric photoresist. A second deep etching step preferably performed by DRIE is performed as shown in FIG. 3F through the opposing surface 17 to yield a peripheral edge having an extractor edge thickness greater than ring extractor substrate thickness defining the thickness of the hole array 21. While the thickness of the hole array 21 is critical to facilitate droplet propagation and impede flow when the thickness of the hole array 21 is excessive, no such limitation exists for the peripheral edge thickness 27. The peripheral edge thickness 27 is typically between 130 and 1500 percent of the thickness 21 of the hole array region 23. For the exemplary case of silicon, the peripheral edge thickness is preferably between 300 and 800 and the hole array region thickness is between 30 and 250 microns The resultant ring extractor 25' is released from the carrier 24 by conventional means such as solvent dissolution of the grease, and optionally any remaining disparate surface material layer 14 or 14' is removed by conventional process specific to the nature of the layer, FIGS. 4A-4C are transverse cross-sectional schematics showing the steps of forming a ring extractor through a laser boring process. In FIG. 4A, a substrate ring extractor substrate 12 is either a ring extractor substrate 12 or a substrate having thickness 21 in the hole array region 23 and a peripheral edge 26 having a thickness 27 greater than the thickness 21. The substrate 12 is then mounted and portions of the hole array region 23 are subjected to laser beam radiation spot shaped to define a desired dimension of a hole 30. The movement of the substrate 12 relative to the laser beam radiation spot 30 defining the dimensions of a hole is moved in a controlled manner through resort to a piezoelectric stepper (not shown) to provide an array of holes 18, as shown in FIG. 4B. It is appreciated that resort to laser boring affords additional material options for the formation of a ring extractor 25 or 25' in that substrate materials amenable to selective etching in some instances lack stability in the environment that an integrated multiplex electrospray may be employed such as in highly oxidizing environments.

Figures 5A, 5B, 5C:
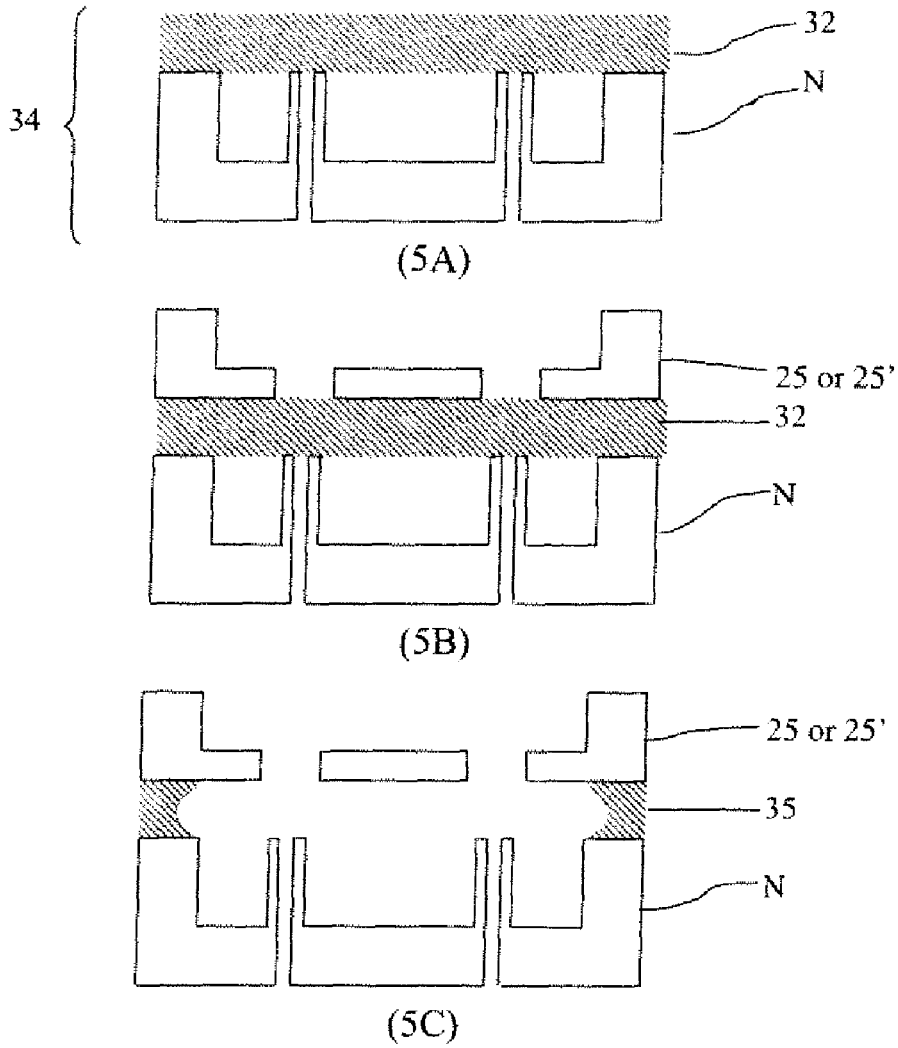
FIGS. 5A-5C are transverse cross-sectional schematics showing the steps of fabricating a multiplexed electrospray device through formation of a bonded stack between a spacer-nozzle array (FIG. 5A), aligning and bonding the bonded stack with a complementary ring extractor (FIG. 5B), and selectively etching the spacer (FIG. 5C).

The formation of a nozzle array formed from a planar nozzle array substrate and having a nozzle array thickness to define multiple nozzles each having a height, an inner diameter and having a preselected spacing of nozzles has been previously described (Deng et al. 2006a, Tang et al. 2001). It is appreciated that a nozzle array layer according to the present invention is readily formed of the materials detailed from which a ring extractor 12 is formed, FIGS. 5A-5C are transverse cross-sectional schematics showing the steps of fabricating a multiplexed electrospray device through formation of a bond stack 34 between a spacer layer 32 and a nozzle array layer N. A spacer layer 32 is formed of a variety of materials with the only limitation being that the spacer layer 32 is preferentially etched relative to the ring extractor 25 or 25' and a nozzle array layer N. More preferably, the spacer layer 32 is a dielectric to electrically isolate voltage sources applied in electrical communication with the nozzle array layer N and a second voltage source in electrical communication with the ring extractor 25 or 25'. Still more preferably, the spacer layer 32 is transparent to facilitate alignment. As shown in FIG. 5A, a spacer layer 32 is bonded to a nozzle array layer N. It is appreciated that an alternative to a separate spacer layer 32, a thin film dielectric film spacer layer 32 is deposited onto the nozzle array layer N, the ring extractor 25 or 25', or on both such that a thin film dielectric layer is intermediate between the ring extractor 25 or 25', and the nozzle array layer N. Anodic bonding procedures known to the art (Despont, 1996) are operative herein to bond either a separate spacer or a thin film dielectric film layer 32 and provide electrical insulation between device electrodes as depicted in FIG. 1. In addition to anodic bonding, it is appreciated that adhesives such as thermal adhesives compatible with the intended operating conditions of multiplexed electrospray atomizer represent an alternative to anodic bonding. In the instance when the ring extractor 25 or 25' and the nozzle array layer N are both acid tolerant such as when formed of silicon, ceramics, or refractory metals, the separate spacer layer 32 is preferably a Pyrex wafer. Typical thicknesses for such a Pyrex wafer are from 100 to 1000 microns and more typically between 300 and 600 microns. The Pyrex wafer is bonded to a nozzle array layer N under illustrative conditions of a 1 kilovolt potential across the wafer stack at 300° Celsius and 1 bar of force, as shown in FIG. 5A. Preferably, the voltage bias is removed from the bonded stack when the current falls below 10% of initial value to ensure sufficient mobile sodium ion content within the glass to achieve a second bond. The ring extractor 25 or 25' is aligned to the bond stack using bond aligner so as to obtain a concentric alignment between the central axis of a nozzle and the center of ring extractor hole an alignment tolerance of less than 10 microns and preferably less than about 5 microns, as shown in FIG. 5B. Bond alignment is readily performed with a conventional bond aligner such as Model BA-6 (Karl Suss, Garching, Germany).Upon alignment between the ring extractor 25 or 25' with the bond stack 34 formed between the separate spacer layer 32 and the nozzle array layer N, the anodic bonding procedure used to bond spacer 32 to nozzle array layer N is repeated with the separate spacer 32 bonded intermediate between the ring extractor 25 or 25' and the nozzle array layer N. The resultant three layer stack of ring extractor 25 or 25'—spacer 32—nozzle array layer N is then subjected to conditions to preferentially etch the spacer layer 32 to achieve fluid communication between the nozzles and the opposing surface 17 of the ring extractor 25 or 25' and form a spacer 35. As a thin film dielectric spacer layer 32 is deposited onto the contours of the ring extractor 25 or 25' and or nozzle array layer N, this approach has the advantage of not requiring a separate spacer etch step to form the spacer 35.

Figure 6A:
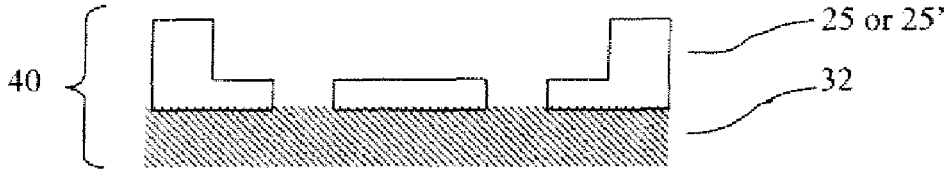
FIGS. 6A-6C are transverse cross-sectional schematics showing the steps of fabricating a multiplexed electrospray device through formation of a bonded stack between a spacer-ring extractor (FIG. 6A), aligning and bonding the bonded stack with a complementary nozzle array (FIG. 6B), and selectively etching the spacer (FIG. 6C).
Figure 6B:
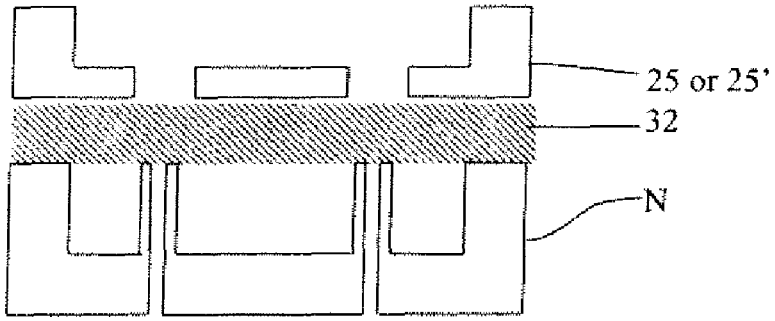
Figure 6C:
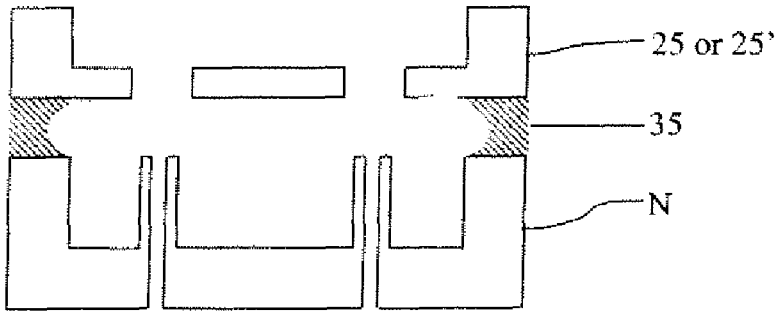

FIGS. 6A-6C are transverse cross-sectional schematics showing the steps of fabricating a multiplexed electrospray device through the formation of a bond stack 40 between a spacer layer 32—ring extractor 25 or 25' and then aligning and bonding the bonded stack with a complementary nozzle array layer N. FIGS. 6A-6C are identical to those detailed with respect to FIG. 5 with the exception that the bonded stack 40 is formed between spacer layer 32 and ring extractor 25 or 25'.

Figure 7A:
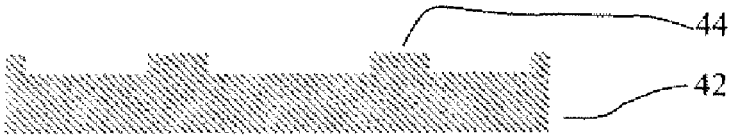
FIGS. 7A-7D are transverse cross-sectional schematics showing a ring extractor mold being used to form a ring extractor and also serves as a spacer in a completed multiplexed electrospray device.
Figure 7B:
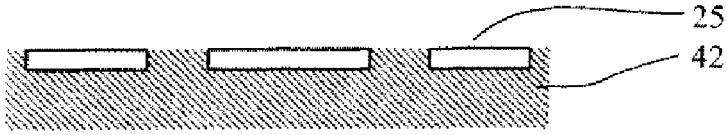
Figure 7C:
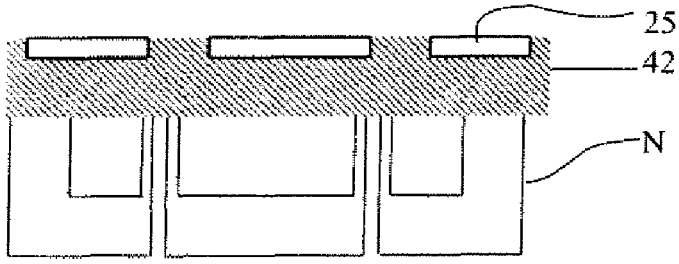
Figure 7D:
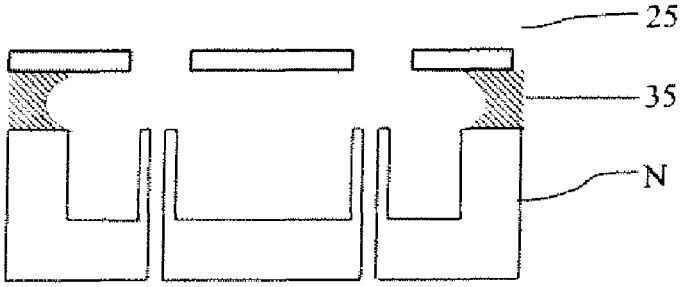

A further integrated formation process is depicted with respect to FIGS. 7A-7D in which a ring extractor mold is formed by a process detailed with respect to FIG. 2 or 3 with the mold being filled with a material to form a ring extractor and the mold also optionally serves as a spacer layer in a completed multiplexed electrospray device. FIG. 7A depicts a mold 42 formed from a material used to form a ring extractor material 12. The mold 42 has protrusions 44 and dimensions complementary to a ring extractor 25 as detailed with respect to FIG. 2. The mold 42 is formed of a material to be preferentially etchable relative to a ring extractor 25 and a nozzle array layer N. The mold 42 is filled with resort to conventional deposition techniques such as electrochemical deposition, atomic layer deposition, injection molding, casting, or the like. Any mold overburden is optionally removed with resort to chemical mechanical polishing, reactive ion etching, or other conventional planarization techniques. It is appreciated that a ring extractor opposing surface 17 is optionally coated with a disparate material layer 14 such as silicon carbide or other such substance to provide a hard coating, oxidation barrier, chemical passivation, or the an electrode layer, or multiple layers can be formed to provide multiple benefits. Preferably, the mold 42 is formed of a material also having the attributes of spacer layer 32 as shown in FIG. 7B. The mold 42 encompassing ring extractor 25 is then aligned and bonded with a nozzle array liner N detailed with respect to FIG. 5B. The mold 42 is then preferentially etched to form a spacer 35 as shown in FIG. 7D and detailed with respect to FIG. 5C.

References Cited

Bocanegra, R., Galán, D., Márquez, M., Loscertales, I. G., and Barrero, A., 2005: Multiple electrosprays emitted from an array of holes, *Journal of Aerosol Science,* 36, pp. 1387-1399.

Deng, W., Klemic, J. F., Li, X., Reed, M. A., and Gomez, A., 2006a: Increase of electrospray throughput using multiplexed microfabricated sources for the scalable generation of monodispersed droplets, *Journal of Aerosol Science,* 37, pp. 696-714.

Deng, W., Waits, C. M., Jankowski. N., Geil, B. and Gomez, A., 2006b; Optimization of Multiplexed Microfabricated Electrospray Sources to Increase the Flow Rate of Monodispersed Droplets. To be presented at the 7th International Aerosol Conference, St. Paul, Minn.

Despont, M., Gross, H., Arrouy, F., Stebler, C., Staufer, U., 1996: Fabrication of a silicon-Pyrex-silicon stack by a.c. anodic bonding, *Sensors and Actuators A,* 55, pp. 219-224.

Epstein, A. H. and coauthors, 1997: Power MEMS and microengines. Proceeding of the 9th international Conference on Solid-State Sensors and Actuators, Chicago, Ill., pp. 753-756.

Fréchette, L. G., Lee, C., Arsian, S. and Liu, Y.-C., 2003: Preliminary Design of a MEMS Steam Turbine Power Plant-on-a-chip. Proceeding of the 3rd International Workshop on Micro & Nano Technology for Power Generation & Energy Conversion (Power MEMS'03), Makuhari, Japan, pp. 1-4.

Kyritsis, D., Guerrero-Arias, I., Roychoudhury, S. and Gomez, A., 2002: Mesoscale Power Generation by a Catalytic Combustor Using Electrosprayed Liquid Hydrocarbons. Proceeding of the Combustion Institute, 20, pp. 965-972.

Tang, K., Lin, T., Matson, D. W., Kim, T., Smith, R. D., 2001: Generation of multiple electrosprays using microfabricated emitter arrays for improved mass spectrometric sensitivity, *Analytical Chemistry,* 73, pp. 1658-1663.

Walther, D. C. and Pisano, A. P., 2003: MEMS Rotary Engine Power System: Project Overview and Recent Research Results. Proceeding of the 4th International Symposium on MEMS and Nanotechnology, Charlotte, N.C., pp. 227-234.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. An improved process for fabricating an integrated multiplexed electrospray atomizer containing a ring extractor, a nozzle array layer and a spacer intermediate between the ring extractor and the nozzle array layer, said process comprising:

Forming a plurality of holes in a ring extractor substrate to create the ring extractor;

providing the nozzle array layer having a plurality of nozzles, each of said plurality of nozzles defining a central axis;

bonding a planar spacer layer to one of the ring extractor or the nozzle array layer to form a bonded stack of spacer-ring extractor or spacer-nozzle array layer, the improvement including that the spacer layer is an un-patterned substrate formed in-situ and does not require alignment;

aligning said un-patterned bonded stack of spacer layer-ring extractor with the nozzle array layer or said un-patterned bonded stack of spacer-nozzle array layer with the ring extractor;

bonding said un-patterned bonded stack of planar spacer-ring extractor to the nozzle array layer or said bonded stack of spacer-nozzle array layer to the ring extractor such that the un-patterned spacer layer is intermediate between the ring extractor and the nozzle array layer to form a bonded stack of nozzle array layer-spacer-ring extractor; and said improvement being, etching said planar spacer layer within a bonded stack of nozzle array layer-spacer-ring extractor to provide fluid communication between the nozzle array layer and the ring extractor and to form the spacer.

2. The process of claim 1 wherein said bonding of said un-patterned planar spacer layer to one of the ring extractor or the nozzle array layer is by anodic bonding.

3. The process of claim 1 wherein said spacer layer is a material having a differential etch rate relative to the bonded ring extractor and the bonded nozzle array layer, said spacer layer being optically transparent.

* * * * *